US007062919B2

(12) United States Patent
Alkabie

(10) Patent No.: US 7,062,919 B2
(45) Date of Patent: Jun. 20, 2006

(54) VORTEX FUEL NOZZLE TO REDUCE NOISE LEVELS AND IMPROVE MIXING

(75) Inventor: Hisham Alkabie, Oakville (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 11/055,598

(22) Filed: Feb. 11, 2005

(65) Prior Publication Data

US 2005/0144956 A1 Jul. 7, 2005

Related U.S. Application Data

(62) Division of application No. 10/320,488, filed on Dec. 17, 2002, now Pat. No. 6,886,342.

(51) Int. Cl.
*F02C 7/22* (2006.01)
*F23R 3/12* (2006.01)
*F23R 3/30* (2006.01)

(52) U.S. Cl. ..... 60/776; 60/725; 431/114

(58) Field of Classification Search ..... 60/772, 60/776, 725, 749, 750; 431/114
See application file for complete search history.

(56) References Cited

U.S. PATENT DOCUMENTS

| | | | | |
|---|---|---|---|---|
| 2,967,394 | A * | 1/1961 | Jensen | 60/737 |
| 5,433,596 | A * | 7/1995 | Dobbeling et al. | 431/350 |
| 5,498,155 | A * | 3/1996 | Chyou et al. | 431/350 |
| 6,871,503 | B1 * | 3/2005 | Inoue et al. | 60/737 |
| 6,886,342 | B1 * | 5/2005 | Alkabie | 60/740 |

* cited by examiner

*Primary Examiner*—Ted Kim
(74) *Attorney, Agent, or Firm*—Ogilvy Renault LLP

(57) ABSTRACT

A method of reducing engine noise generation by decoupling: acoustic and hydrodynamic fluctuation generated by a compressor and a fuel supply system; from acoustic and hydrodynamic fluctuation of a combustor, by: deflecting fuel jets into a fuel nozzle mixing chamber in a number of counter-rotating adjacent pairs of fuel laden vortices; emitting a resulting fuel-air mixture into the combustor downstream from the fuel nozzle mixing chamber.

2 Claims, 7 Drawing Sheets

VORTEX FUEL NOZZLE TO REDUCE NOISE LEVELS AND IMPROVE MIXING

RELATED APPLICATION

This application is a divisional of Ser. No. 10/320,488 filed Dec. 17, 2002, now U.S. Pat. No. 6,886,342 issued: May 3, 2005.

TECHNICAL FIELD

The invention relates to a method of reducing engine noise levels and improving fuel/air mixing using a fuel nozzle with cross-currents of fuel and air vortices.

BACKGROUND OF THE ART

Gas turbine engines include a pressurized fuel supply system that is mechanically linked to the rotation of the compressor through an accessory gear box. The combustor receives compressed air from the compressor and therefore the supply of pressurized fuel and compressed air to the combustor is significantly affected by fluctuation in the engine operation.

Evidence indicates that there is a strong coupling effect between: (1) the acoustic and hydrodynamic fluctuation generated by the compressor and fuel supply system; and (2) the acoustic and hydrodynamic fluctuation generated by the combustor. Combustion instability is introduced into the combustion system by perturbations imposed on the fuel nozzle injection ports by the fuel supply system and by the air supply system through the compressor and diffuser upstream of the combustor.

Objects of the invention will be apparent from review of the drawings and description of the invention below.

DISCLOSURE OF THE INVENTION

The invention provides a method of reducing engine noise generation by decoupling: acoustic and hydrodynamic fluctuation generated by a compressor and a fuel supply system; from acoustic and hydrodynamic fluctuation of a combustor, by: deflecting fuel jets into a fuel nozzle mixing chamber in a number of counter-rotating adjacent pairs of fuel laden vortices; emitting a resulting fuel-air mixture into the combustor downstream from the fuel nozzle mixing chamber.

DESCRIPTION OF THE DRAWINGS

In order that the invention may be readily understood, embodiments of the invention are illustrated by way of example in the accompanying drawings.

Further details of the invention and its advantages will be apparent from the detailed description included below.

DETAILED DESCRIPTION OF PREFERRED EMBODIMENTS

Figure 1:
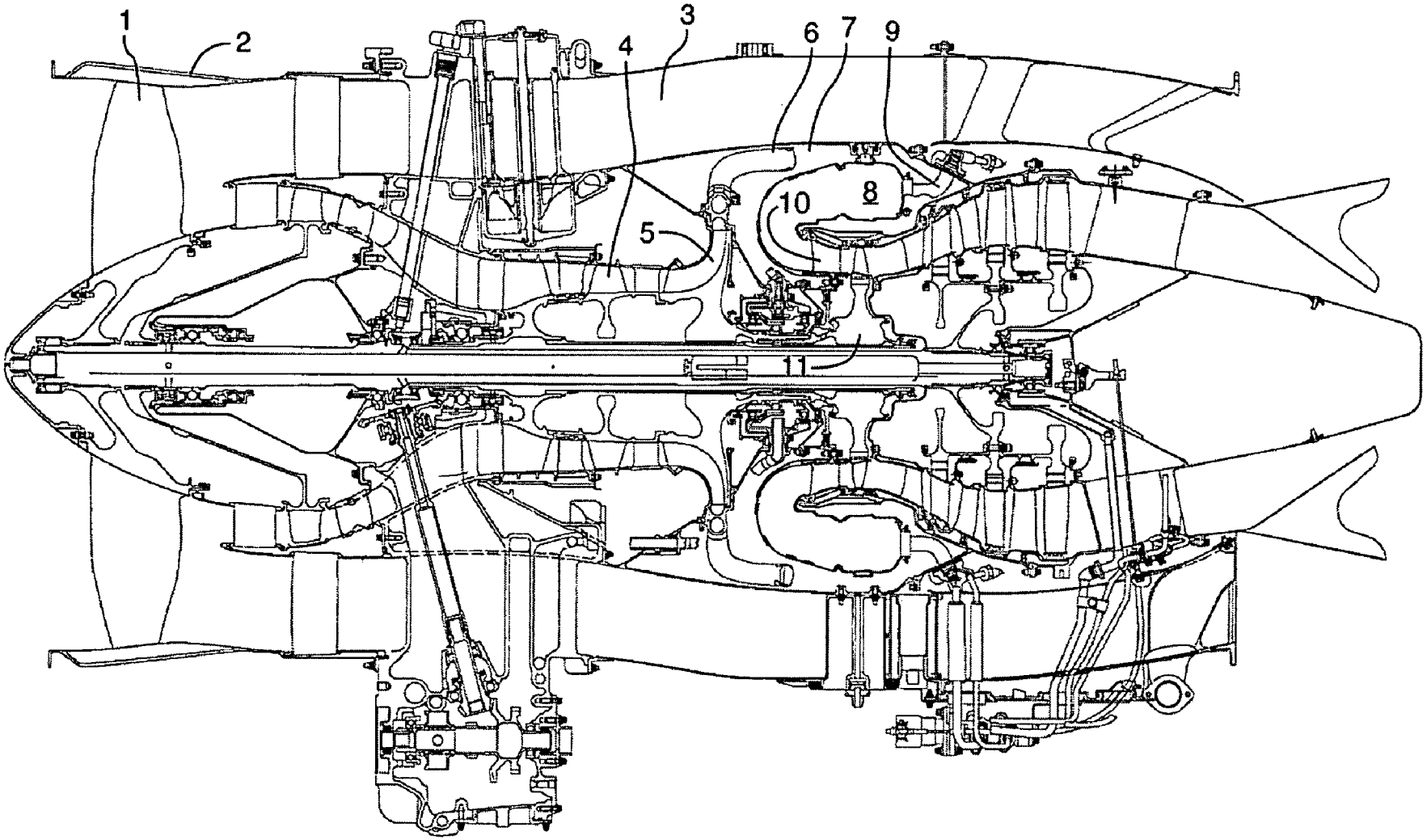
FIG. 1 is an axial cross sectional view through a typical turbofan gas turbine engine showing general arrangement of the components and in particular showing the fuel supply, air compressor sand combustor arrangement.

FIG. 1 shows an axial cross-section through a turbofan gas turbine engine. It will be understood however that the invention is also applicable to any type of engine with a combustor and turbine section such as a turboshaft, a turboprop, industrial gas turbine or auxiliary power unit. Air intake into the engine passes over fan blades 1 in a fan case 2 and is then split into an outer annular flow through the bypass duct 3 and an inner flow through the low-pressure axial compressor 4 and high-pressure centrifugal compressor 5. Compressed air exits the compressor 5 through a diffuser 6 and is contained within a plenum 7 that surrounds the combustor 8. Fuel is supplied to the combustor 8 through fuel supply tubes 9 which is mixed with air from the plenum 7 when sprayed through nozzles into the combustor 8 as a fuel-air mixture that is ignited. A portion of the compressed air within the plenum 7 is admitted into the combustor 8 through orifices in the side walls to create a cooling air curtain along the combustor walls or is used for cooling to eventually mix with the hot gases from the combustor and pass over the nozzle guide vane 10 and turbines 11 before exiting the tail of the engine as exhaust.

Figure 2:
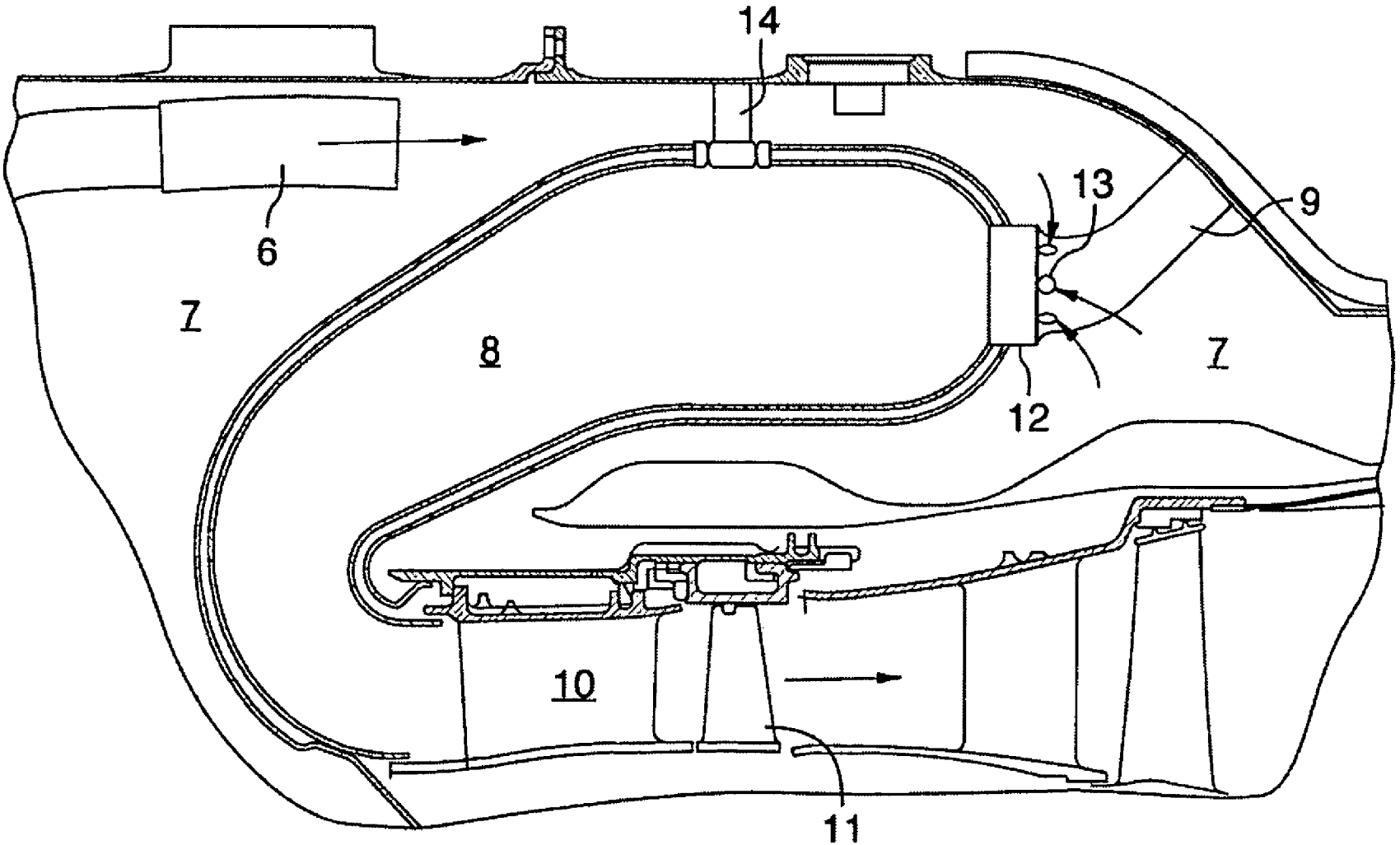
FIG. 2 is a detailed axial cross-sectional view through a reverse flow combustor with a fuel nozzle in accordance with a first embodiment of the invention.
Figure 3:
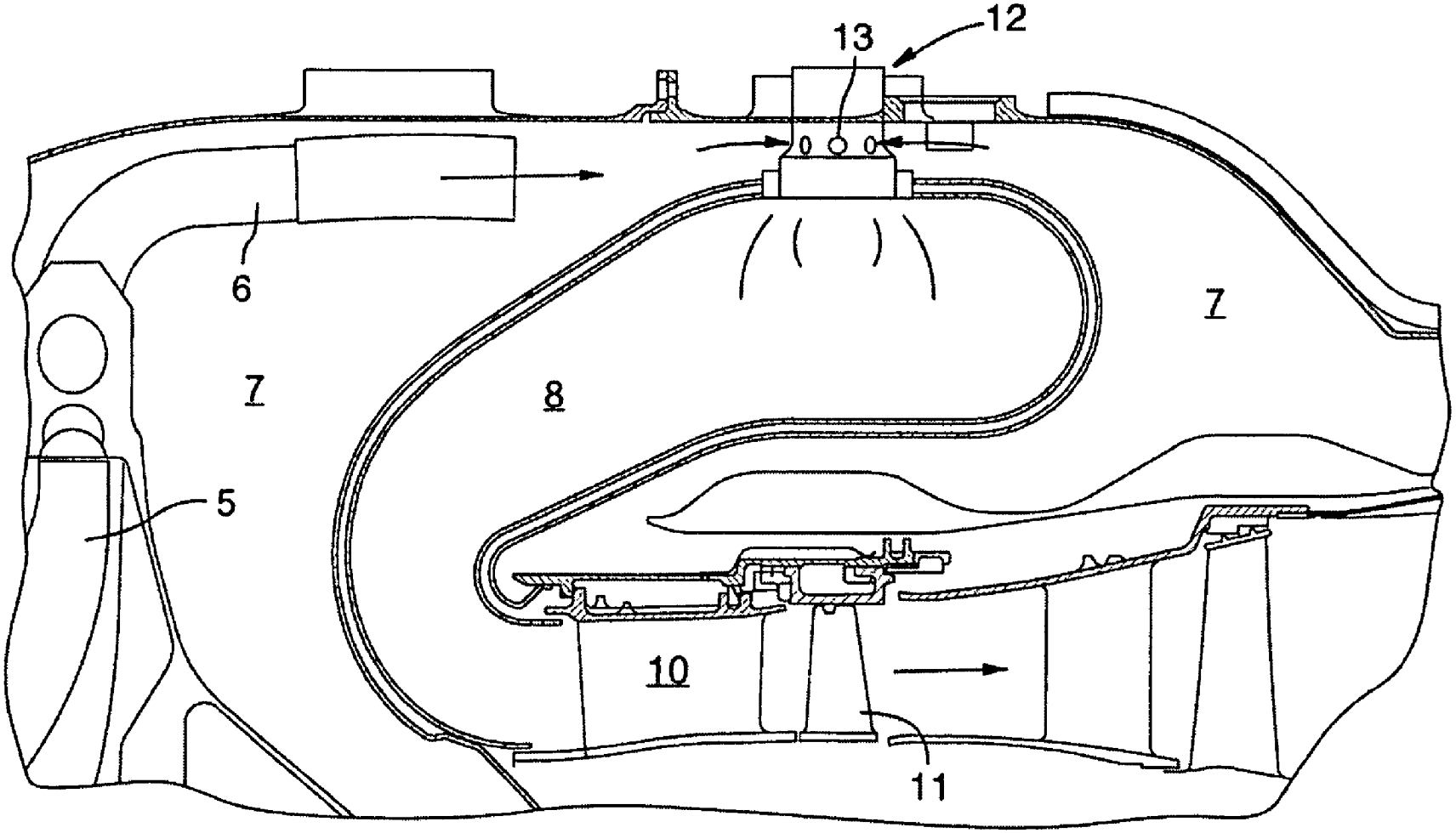
FIG. 3 is a like detail axial sectional view through a reverse flow combustor with the fuel nozzle disposed in a different location in accordance with the second embodiment of the invention.

FIGS. 2 and 3 show first and second embodiments of a fuel nozzle 12 located in a reverse flow combustor. It will be understood however that a fuel nozzle 12 can be installed in a straight flow combustor or any other combustor configuration. As indicated in FIGS. 2 and 3, compressed air from the diffuser 6 is contained within the plenum 7 and enters through air inlet openings 13 in the nozzle 12 to be mixed with fuel and then to be propelled under pressure into the combustor 8 for ignition. FIG. 2 shows a separate igniter 14 whereas FIG. 3 indicates that the igniter 14 may be housed within the centre of the nozzle 12 in a compact fuel nozzle-igniter unit. A centrally placed igniter provides the possibility for eliminating primary fuel injection during the start up conditions.

Figure 4:
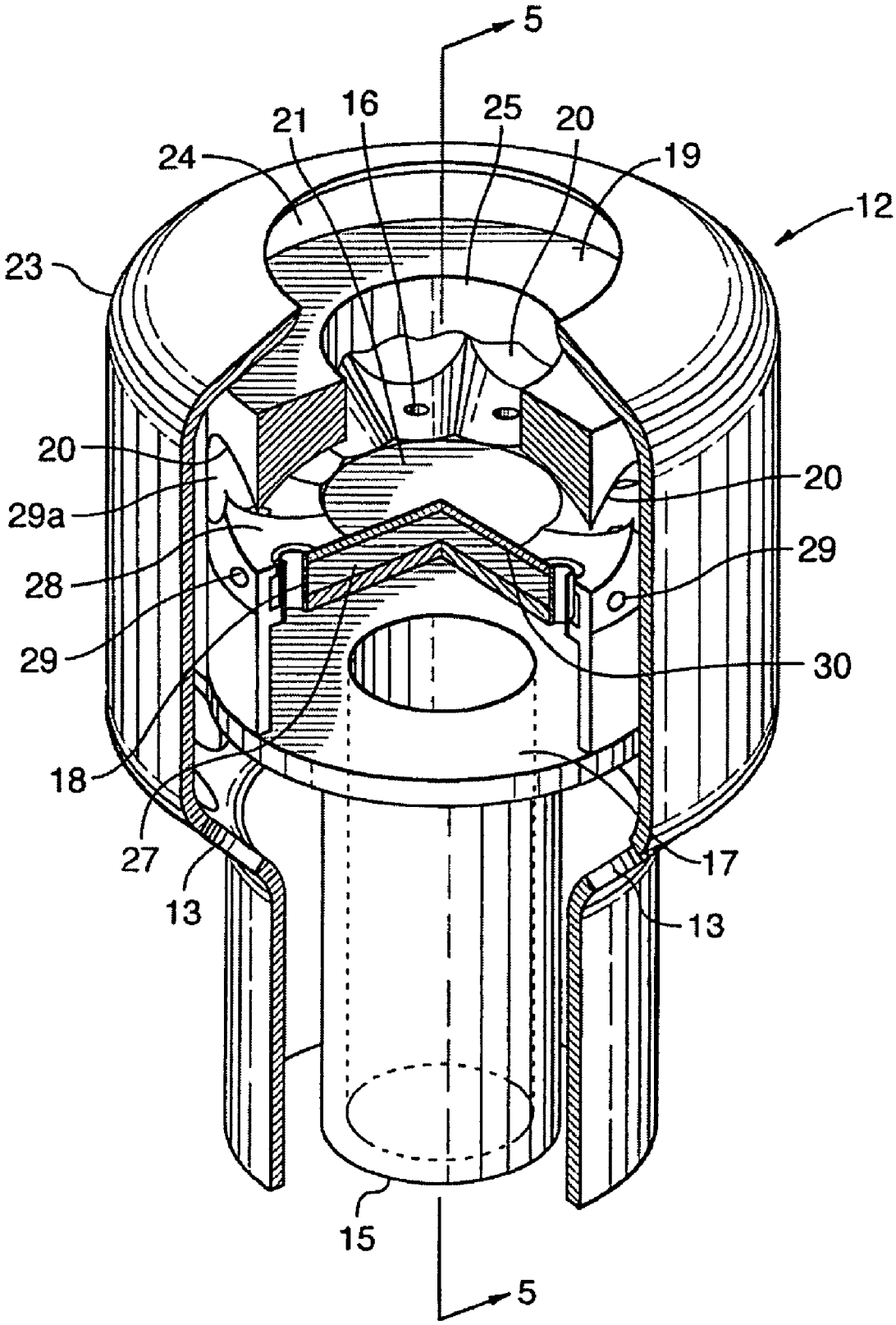
FIG. 4 is a partially cut away isometric view of a fuel nozzle in accordance with the invention.
Figure 5:
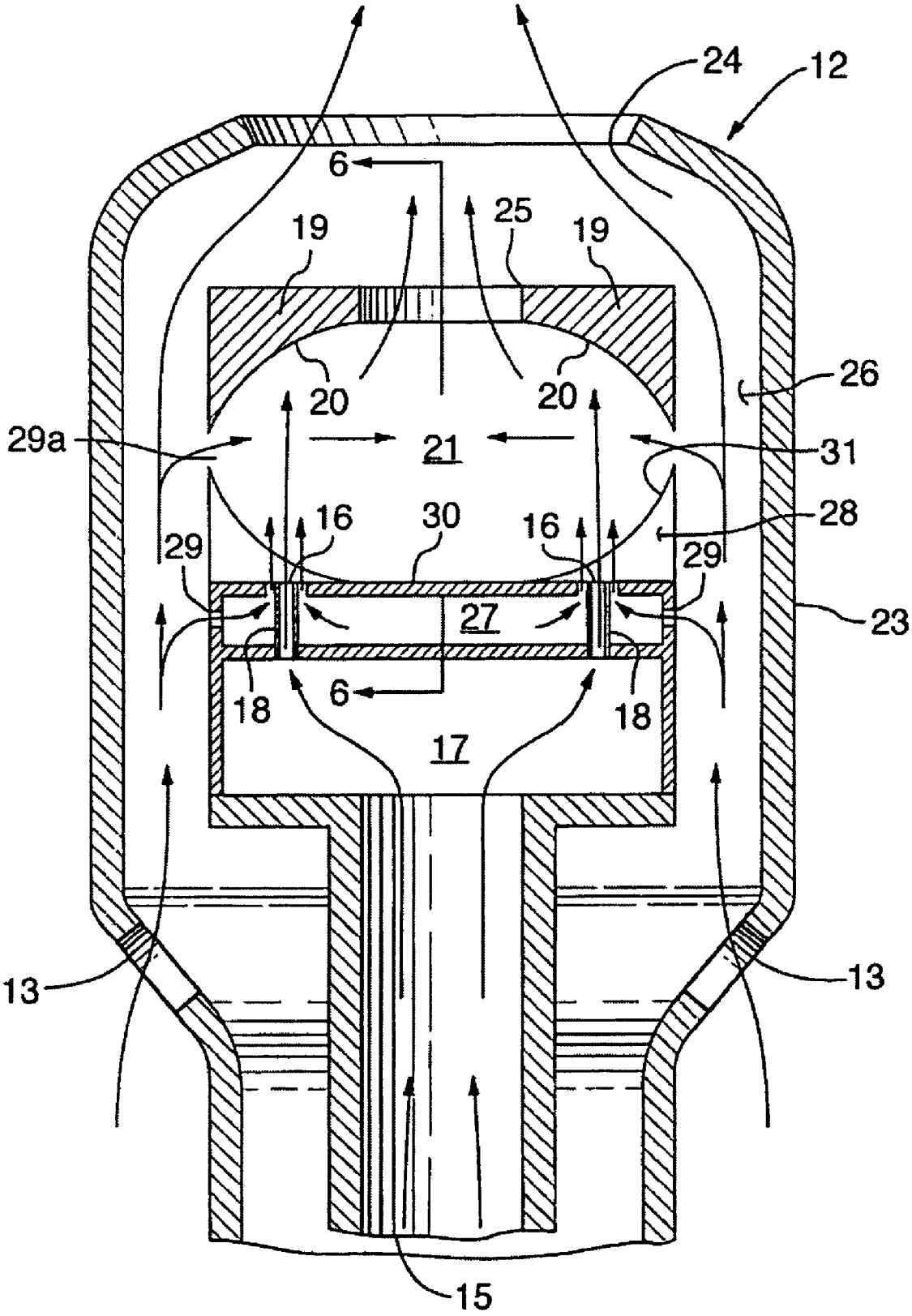
FIG. 5 is a sectional view along lines 5—5 of FIG. 4 showing details of the internal components of the fuel nozzle.

FIGS. 4 and 5 show details of the fuel nozzle 12 construction. Fuel is conveyed through the fuel supply tube 9 and enters a fuel inlet 15 which is in communication with a plurality of fuel spray orifices 16 via a cylindrical shape fuel distribution gallery 17. The fuel gallery 17 includes cylindrical side walls and disc shaped top and bottom walls. The top wall supports a plurality of fuel spray tubes 18 having a lower end in communication with the fuel gallery 17. The fuel spray tubes 18 have a distal end with fuel spray orifices 16 directed towards a generally annular fuel vortex generator 19 having a scalloped fuel deflecting surface 20 disposed downstream a distance from each fuel spray orifices 16.

Figure 6:
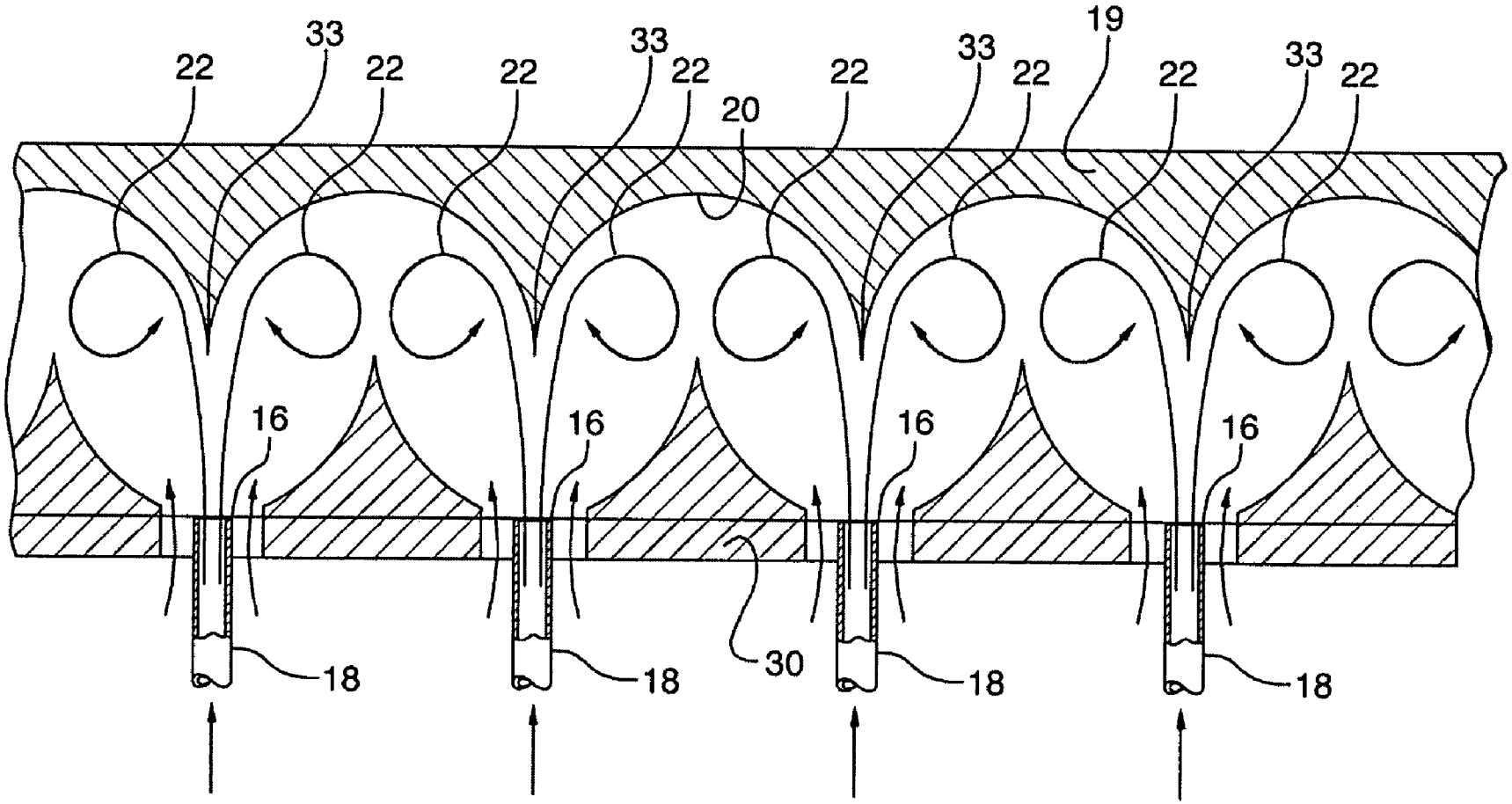
FIG. 6 is a detailed view showing a section through the fuel nozzle along lines 6—6 of FIG. 5 showing miniature fuel injection tubes directing fuel jets at cusps in the fuel deflecting surface of the fuel vortex generator.

A central mixing chamber 21 is defined between the fuel spray orifices 16 and the contoured or scalloped fuel deflecting surface 20. As best seen in FIG. 6, the fuel deflecting surface 20 has a surface contour oriented to deflect fuel jets sprayed from the fuel orifices 16 into the mixing chamber 21 in a plurality of counter rotating adjacent pairs of fuel laden vortices 22.

As seen in FIGS. 4 and 5, the fuel nozzle 12 in the embodiment illustrated also includes an external shield 23 into which compressed air flows from the plenum 7 through air inlet openings 13, flows downstream to mix with fuel in the mixing chamber 21 and then exits through the annular airflow outlet 24 that surrounds the fuel-air mixture outlet 25 from the mixing chamber 21. The external shield 23 defines an annular air supply passage 26. The external shield 23 also internally houses and supports the fuel gallery 17, fuel vortex generators 19, air assist gallery 27 and airflow vortex generator 28 which will be described below.

The air supply passage 26 provides air flow to the mixing chamber 22 by two paths. Firstly air flows through inlet openings 29 into the air assist gallery 27 which surrounds each fuel spray tube 18. The air assist gallery 27 includes a cover plate 30 through which the fuel tubes 18 extend. Each fuel tube 18 is surrounded by an annular air assist opening in the cover plate 30 to provide an annular flow of air directed parallel to the fuel jet ejected through the fuel spray orifices 16 as indicated by arrows in FIG. 5.

It will be understood that the fuel jets emitted through the fuel spray orifices 16 are surrounded by an annular flow of air traveling parallel and impinging on the fuel deflecting surface 20 of the fuel vortex generator 19 to create (as shown in FIG. 6) pairs of counter rotating fuel vortices 22.

As shown in FIG. 5, the air conveyed through the annular air supply passage 26 also supplies air that flows into the mixing chamber 21, via an air inlet 29*a* defined between the fuel vortex generator 19 and the airflow vortex generator 28, in a direction generally transverse to the direction of fuel jets emitted from the fuel spray orifices 16 into the mixing chamber 21. The resulting fuel-air mixture proceeds to the fuel-air outlet 25 downstream from the mixing chamber 21.

Figure 7:
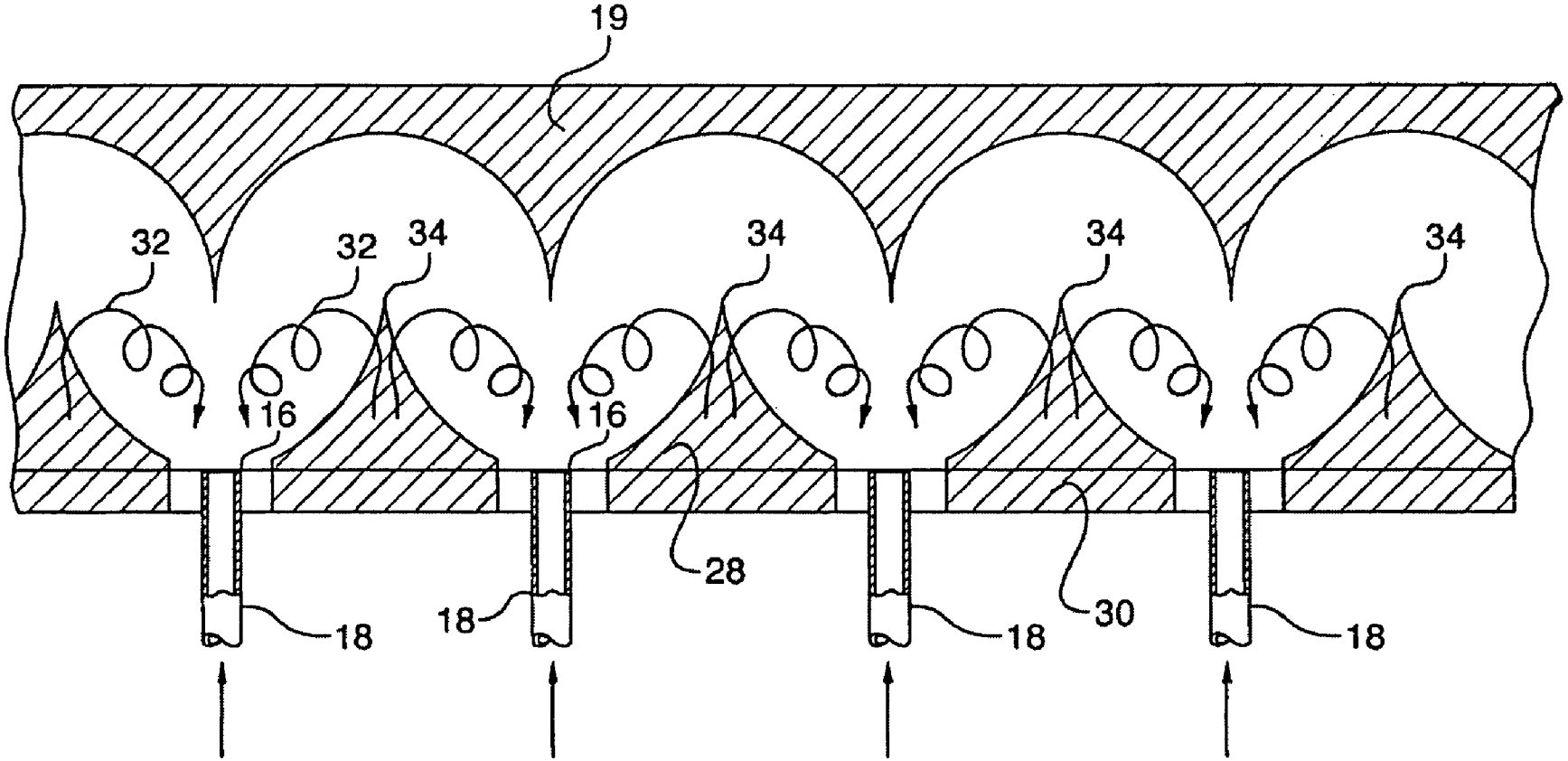
FIG. 7 is a like sectional view showing counter rotating adjacent pairs of airflow vortices created as airflow over the airflow separation edges disposed between fuel jets.

As seen in FIGS. 5 and 7, the fuel nozzle 12 also includes an air flow vortex generator 28 which is disposed between the air supply passage 26 and the mixing chamber 21. The air flow vortex generator 28 has an air flow deflecting surface 31 with a surface contour oriented to deflect air flow into the mixing chamber 21 in a plurality of counter rotating adjacent pair of airflow vortices 32 as illustrated in FIG. 7. It will be understood from FIG. 5 that the counter rotating pairs of airflow vortices 32 are deflected into a transverse direction relative to the fuel jets emitted through the fuel spray orifices 16. The fuel jets impinge on the fuel deflecting surface 20 and the resulting fuel vortices 22 are swept downstream by the airflow vortices 32 into the mixing chamber 21. The nozzle 12 as illustrated is symmetric about a central axis and the fuel jets are directed axially downstream whereas the counter rotating pairs of airflow vortices 32 are directed radially inwardly towards the mixing chamber 21.

As shown in FIG. 6, the fuel deflecting surface 20 of the fuel vortex generator 19 includes cusps 33 pointed towards each fuel spray orifice 16 with a concave arc extending adjacent cusp 33. The fuel jet is therefore separated and guided by the fuel deflecting surface 20 to create counter rotating pairs of fuel laden vortices 22 as indicated in FIG. 6. As shown in FIG. 7, the airflow deflecting surface 31 of the airflow vortex generator 28 includes a flow separation edge 34 disposed between adjacent fuel spray orifices 16 and a concave arch extends between separation edges 34.

The fuel nozzle 12 therefore utilizes the phenomenon of counter rotating stream wise vorticity to eliminate or reduce the coupling effect on the fuel-air mixture before combustion takes place. One set of counter rotating vortices 22 is generated by the pressurized fuel jets impinging on the deflecting surface 20 of the fuel vortex generator 19. Airflow vortices 32 are generated as airflow goes through flow separation over separation edges 34. The superposition of two counter rotating vortices 22, 32 further benefits mixing for improving efficiency and reducing emissions from the combustion process due to an increase in shear contact area between turbulent air/fuel, air/air, and fuel/fuel layers.

Although the above description relates to a specific preferred embodiment as presently contemplated by the inventor, it will be understood that the invention in its broad aspect includes mechanical and functional equivalents of the elements described herein.

I claim:

1. A method of reducing engine noise generation by decoupling acoustic and hydrodynamic fluctuation generated by a compressor and a fuel supply system from acoustic and hydrodynamic fluctuation of a combustor, the method comprising:

directing a plurality of fuel jets, each along a line from fuel spray orifice, at a fuel deflecting surface of a fuel vortex generator, the fuel deflecting surface having a surface contour oriented to deflect the fuel jets into a fuel nozzle mixing chamber in a plurality of counter-rotating adjacent pairs of fuel laden vortices the vortices having axes generally transverse to said line along which the fuel jets are directed;

directing a flow of air into said mixing chamber independently of the fuel jets at an air flow deflecting surface of an air flow vortex generator, the air flow deflecting surface having a surface contour oriented to deflect the air flow into the mixing chamber in a plurality of counter-rotating adjacent pairs of airflow vortices;

after deflecting upon the fuel deflecting surface, each of the fuel laden vortices is paired with one of the airflow vortices into pairs that swirl in opposite rotational directions relative to each other; and emitting a resulting fuel-air mixture into the combustor downstream from the fuel nozzle mixing chamber.

2. A method according to claim 1 wherein fuel laden vortices and the airflow vortices each have a swirl velocity that diminishes as the pairs of vortices move from their respective deflecting surfaces toward the mixing chamber.

* * * * *